US006945884B1

(12) United States Patent
Korik

(10) Patent No.: US 6,945,884 B1
(45) Date of Patent: Sep. 20, 2005

(54) TENNIS TEACHING AID

(76) Inventor: Paul T. Korik, 81 Woodland Rd., Guilford, CT (US) 06437

( * ) Notice: Subject to any disclaimer, the term of this patent is extended or adjusted under 35 U.S.C. 154(b) by 88 days.

(21) Appl. No.: 10/755,587

(22) Filed: Jan. 13, 2004

(51) Int. Cl.[7] ..... A63B 69/38
(52) U.S. Cl. ..... 473/464; 473/518
(58) Field of Search ..... 473/464, 422, 473/459, 461, 553, 213, 518, 276; 2/160, 161.1, 161.2, 161.4

(56) References Cited

U.S. PATENT DOCUMENTS

| | | | | | |
|---|---|---|---|---|---|
| 2,709,257 | A | * | 5/1955 | McKinney | 2/16 |
| 4,014,327 | A | | 3/1977 | Spiro | |
| 4,057,255 | A | * | 11/1977 | Bishop | 473/205 |
| 4,088,318 | A | | 5/1978 | Massman | |
| 4,138,108 | A | | 2/1979 | Robinson | |
| 4,176,839 | A | | 12/1979 | Pinkus | |
| 4,209,169 | A | * | 6/1980 | Roberts | 473/464 |
| 4,502,688 | A | | 3/1985 | Papp | |
| 4,684,559 | A | * | 8/1987 | Wasko | 428/100 |
| 4,873,968 | A | | 10/1989 | Finnieston et al. | |
| 5,005,833 | A | * | 4/1991 | Groveman et al. | 473/464 |
| 5,064,198 | A | * | 11/1991 | Szabo | 473/213 |
| 5,401,017 | A | * | 3/1995 | McDonald et al. | 473/213 |
| 5,492,331 | A | * | 2/1996 | Kawakami | 473/213 |
| 5,527,040 | A | * | 6/1996 | Stanley et al. | 473/213 |
| 5,638,548 | A | | 6/1997 | Kawakami | |
| 5,740,555 | A | * | 4/1998 | Renegar | 2/161.2 |
| 6,006,358 | A | * | 12/1999 | Keating | 2/161.1 |
| D456,081 | S | | 4/2002 | Bell et al. | |
| 2004/0018899 | A1 | * | 1/2004 | Thiruppathi | 473/464 |
| 2004/0060096 | A1 | * | 4/2004 | Thiruppathi | 2/161.1 |

* cited by examiner

*Primary Examiner*—Raleigh W. Chiu

(57) ABSTRACT

A tennis teaching aid includes a glove member including a palm covering, a back covering and a plurality of fingers sleeves. The finger sleeves are positioned for each receiving one of five fingers on the hand. A wrist sleeve is attached to a bottom edge of the glove member and extends away therefrom. The wrist sleeve includes a front portion positioned adjacent to the palm covering and a rear portion positioned adjacent to the back covering. A flexible elongated member has a first end and a second end. The first end is attached to the back covering of the glove member. A coupler is attached to the wrist sleeve for removably coupling the second end to the back portion of the wrist sleeve such that a selected angle is formed between the wrist sleeve and the glove member.

4 Claims, 2 Drawing Sheets

TENNIS TEACHING AID

BACKGROUND OF THE INVENTION

1. Field of the Invention

The present invention relates to tennis teaching devices and more particularly pertains to a new tennis teaching device for providing proper hand to arm alignment when striking a tennis ball.

2. Description of the Prior Art

The use of tennis teaching devices is known in the prior art and most of these, such as U.S. Pat. No. 5,005,833 include methods for restricting the movements of the wrist and arms to ensure that the arms move in a correct motion around the body. While these devices fulfill their respective, particular objectives and requirements, the need remains for a device that shows the proper alignment between the hand and arm, which is in general the angle of the wrist, for the variety of shots used in tennis. These shots include forehand, volleying and backhand shots.

SUMMARY OF THE INVENTION

The present invention meets the needs presented above by utilizing a glove positioned on hand which is attached to a wrist sleeve and selectively angled therewith to produce various wrist angles as desired to simulate proper wrist angle when striking a tennis ball.

To this end, the present invention generally comprises a glove member including a palm covering, a back covering and a plurality of fingers sleeves. The finger sleeves are positioned for each receiving one of five fingers on the hand. A wrist sleeve is attached to a bottom edge of the glove member and extends away therefrom. The wrist sleeve is positioned for extending around a wrist when the hand is extended into the glove member. The wrist sleeve includes a front portion positioned adjacent to the palm covering and a rear portion positioned adjacent to the back covering. A flexible elongated member has a first end and a second end. The first end is attached to the back covering of the glove member. A coupler is attached to the wrist sleeve for removably coupling the second end to the back portion of the wrist sleeve such that a selected angle is formed between the wrist sleeve and the glove member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
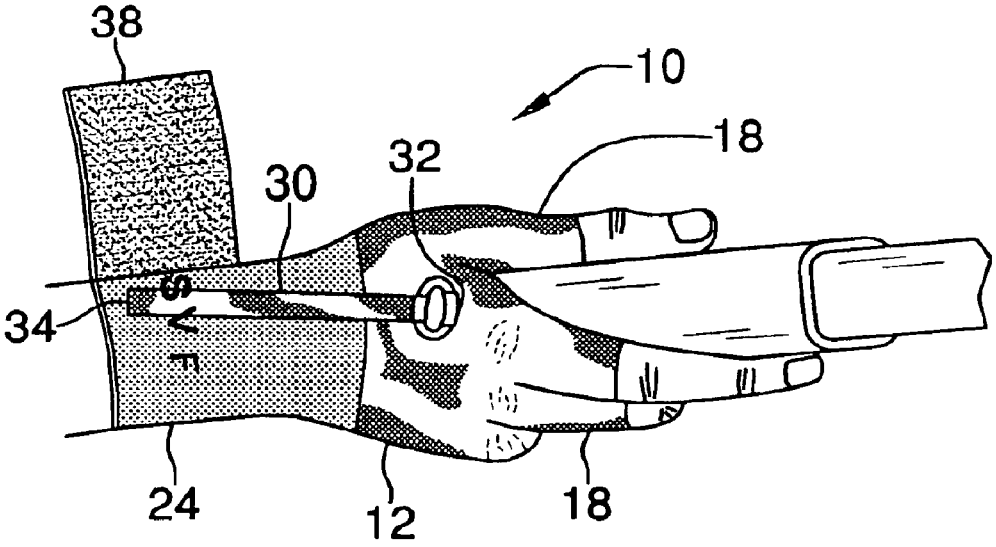
FIG. 1 is a schematic back view of a tennis teaching air according to the present invention.

With reference now to the drawings, and in particular to FIGS. 1 through 4 thereof, a new tennis teaching device embodying the principles and concepts of the present invention and generally designated by the reference numeral 10 will be described.

As best illustrated in FIGS. 1 through 4, the tennis teaching aid 10 generally comprise a glove member 12 that includes a palm covering 14, a back covering 16 and a plurality of fingers sleeves 18. The finger sleeves 18 are positioned for each receiving one of five fingers on the hand. The finger sleeves 18 include an index finger sleeve 20 positioned for receiving an index finger. Each of the finger sleeves 18 preferably has an open end 22 such that the fingers may extend outwardly from the finger sleeves 18. The glove member 12 ideally comprises a resiliently stretchable material.

A wrist sleeve 24 is attached to a bottom edge of the glove member 12 and extends away therefrom. The wrist sleeve is positioned for extending around a wrist when the hand is extended into the glove member 12. The wrist sleeve 24 includes a front portion 26 positioned adjacent to the palm covering 14 and a rear portion 28 positioned adjacent to the back covering 16. The wrist sleeve 24 is also preferably comprised of a resiliently stretchable material.

A flexible elongated member 30 has a first end 32 and a second end 34. The first end 32 is attached to the back covering 16 of the glove member 12 and between the index finger sleeve 20 and the wrist sleeve 24. The first end 32 is positioned between 0.75 inches and 1.25 inches from the index finger sleeve 20.

A coupler is attached to the wrist sleeve 24 for removably coupling the second end 34 to the back portion 28 of the wrist sleeve 24 such that a selected angle is formed between the wrist sleeve 24 and the glove member 12. The coupler includes a flap 36 that is attached to the wrist sleeve 24 at a juncture of the front 26 and rear 28 portions. The flap 36 has a first side 38 that is removably abuttable against the rear portion 28. A hook and loop securing means 40 is attached to the first side 38 of the flap 36 and the rear portion 28 for removably securing the flap 36 to the rear portion 28. The second end 34 of the elongated member 30 is selectively positioned between the flap 36 and the rear portion 28 and thereby secured against the rear portion 28 by the hook and loop securing means 40.

Figure 2:
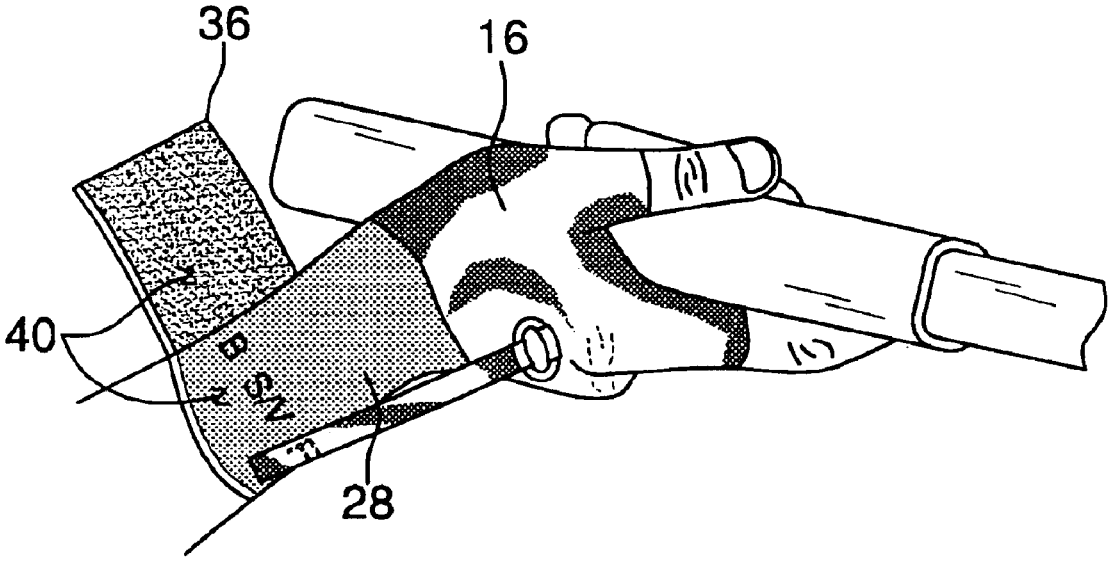
FIG. 2 is a schematic back view of the present invention.
Figure 3:
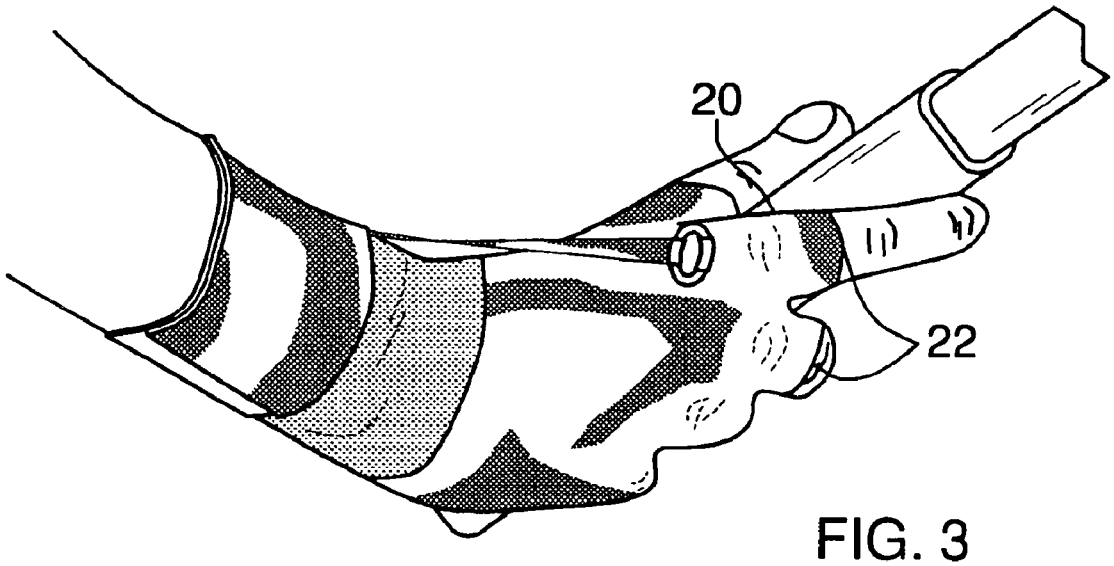
FIG. 3 is a schematic back view of the present invention.
Figure 4:
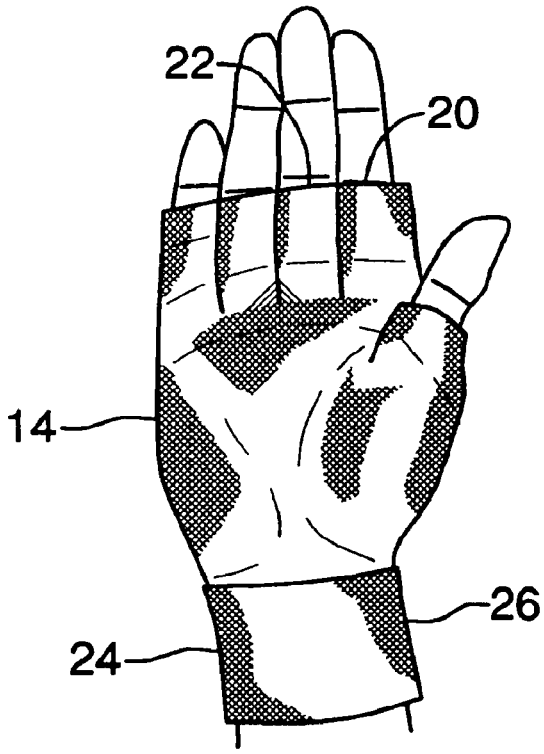
FIG. 4 is a schematic front view of the present invention.

In use, the glove member 12 is positioned over the hand so that the wrist sleeve 24 extends over the wrist. The second end 34 of the elongated member is preferably attached to the rear portion 28 in one of three positions. The first position is depicted in FIG. 1 and is generally near the middle of the wrist. This positions the hand in a slightly turned back position which is the correct position for the volley position of striking a tennis ball. The second position is depicted in FIG. 2 and places the second end 34 near an outer edge of the wrist. This position pulls the hand back so that an angle between 90 degrees and 180 degrees is formed between back of the hand and the arm. The second position is utilized when hitting forehand tennis shots. The third position is depicted in FIG. 3 and places the second end 34 adjacent to the inner edge of the wrist. This position pulls the hand forward so that an angle between 90 degrees and 180 degrees is formed between the palm and the arm. The third position places the hand in the prior position for a backhand tennis short. These positions show the user of the device the proper position so that they have reference points and muscle knowledge for future striking of a tennis ball when the teaching aid is removed from the hand.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of using a tennis training aid device comprising the steps of:

providing a glove member including a palm covering, a back covering and a plurality of fingers sleeves, said finger sleeves being positioned for each receiving one of five fingers on a hand;

providing a wrist sleeve being attached to a bottom edge of said glove member and extending away therefrom, said wrist sleeve being positioned for extending around a wrist when the hand is extended into said glove member, said wrist sleeve including a front portion positioned adjacent to said palm covering and a rear portion positioned adjacent to said back covering;

providing a flexible elongated member having a first end and a second end, said first end being attached to said back covering of said glove member;

providing a coupler being attached to said wrist sleeve for removably coupling said second end to said back portion of said wrist sleeve such that a selected angle is formed between said wrist sleeve and said glove member;

positioning the glove member over the hand so that the wrist sleeve extends over a wrist;

attaching the second end of the elongated member to said back portion is a first position generally near the middle of the back of the wrist, a second position near an outer edge of the wrist or a third adjacent to the inner edge of the wrist for selectively altering an angle of the wrist.

2. The method according to claim 1, wherein said finger sleeves include an index finger sleeve positioned for receiving an index finger, said first end of said elongate member being positioned between said index finger sleeve and said wrist sleeve, said first end being positioned between 0.75 inches and 1.25 inches from said index finger sleeve.

3. The method according to claim 2, wherein said coupler includes a flap being attached to said wrist sleeve at a juncture of said front and rear portions, said flap having a first side having removably abuttable against said rear portion, a hook and loop securing means being attached to said first side of said flap and said rear portion for removably securing said flap to said rear portion, wherein said second end of said elongated member is selectively positioned between said flap and said rear portion.

4. The method according to claim 1, wherein said coupler includes a flap being attached to said wrist sleeve at a juncture of said front and rear portions, said flap having a first side being removably abuttable against said rear portion, a hook and loop securing means being attached to said first side of said flap and said rear portion for removably securing said flap to said rear portion, wherein said second end of said elongated member is selectively positioned between said flap and said rear portion.

* * * * *